US005482517A

United States Patent [19]

Ikeda

[11] Patent Number: 5,482,517

[45] Date of Patent: Jan. 9, 1996

[54] COAL-WATER MIXTURE AND PROCESS FOR PRODUCING SAME

[76] Inventor: Hideji Ikeda, 27-2, Komagome 3-chome, Toshima-ku, Tokyo, Japan

[21] Appl. No.: 242,422

[22] Filed: May 13, 1994

[30] Foreign Application Priority Data

Apr. 13, 1994 [JP] Japan ..... 6-075182

[51] Int. Cl.[6] ..... C10L 9/10

[52] U.S. Cl. ..... 44/280; 44/608; 44/620

[58] Field of Search ..... 44/280, 608, 620

[56] References Cited

U.S. PATENT DOCUMENTS

| | | | |
|---|---|---|---|
| 3,956,140 | 5/1976 | Nahm et al. | 252/8.5 C |
| 4,403,998 | 9/1983 | Schulz | 44/280 |
| 4,465,495 | 8/1984 | Scheffee | 44/280 |
| 4,502,868 | 3/1985 | Yaghmaie et al. | 44/280 |
| 4,969,929 | 11/1990 | Platone et al. | 44/280 |
| 5,112,363 | 5/1992 | Platone et al. | 44/280 |

FOREIGN PATENT DOCUMENTS 85100543 12/1985 China .

124488 11/1984 European Pat. Off. .

*Primary Examiner*—Prince Willis, Jr.
*Assistant Examiner*—Cephia D. Toomer
*Attorney, Agent, or Firm*—Oblon, Spivak, McClelland, Maier & Neustadt

[57] ABSTRACT

A coal-water mixture is disclosed which can be produced without using synthetic additives. After an acid such as a mineral acid is added to coal powder which is obtained by grinding coal such as jet coal or gas coal, water anti a plasticizer, composed of a humic acid derivative, are added to produce the coal-water mixture. The humic acid derivative is produced by grinding brown coal into brown coal powder, and adding and mixing caustic soda and sodium sulfite thereto. By the addition of the mineral acid to the powder of jet coal or gas coal, organic ferrum complexes which act as a stabilizer can be produced. With the use of coal powder in which coarse coal particles of a larger particle size are mixed with fine coal particles of a smaller particle size, the suspension can be further improved.

4 Claims, 1 Drawing Sheet

COAL-WATER MIXTURE AND PROCESS FOR PRODUCING SAME

BACKGROUND OF THE INVENTION

1. Field of the Invention

The present invention pertains to a coal-water mixture or a water-coal suspension which is suitable as a fuel alternative to crude petroleum for steam-power generation, and to a process for producing such a coal-water mixture.

2. Related Art

A coal-water mixture is known which is suitable as a fuel alternative to crude petroleum for steam-power generation. The coal-water mixture of this type has been conventionally produced by grinding coal into a fine powder and mixing it with water.

When considering the actual utilization of the coal-water mixture as a liquid fuel alternative to crude petroleum, an assessment should be made as to whether the coal-water mixture is less expensive or comparable when compared with the price of petroleum. However, in the known coal-water mixture, the addition of synthetic additives was required during manufacture in order to achieve a suspension, thereby resulting in unduly high manufacturing cost.

SUMMARY OF THE INVENTION

It is therefore a primary object of the present invention to provide a coal-water mixture which can be produced at low cost by using less-expensive natural additives obtainable from coal itself.

Another object of the invention is to provide a process which is specifically suitable to produce the aforesaid coal-water mixture.

According to a first aspect of the present invention, there is provided a coal-water mixture containing water, coal powder suspended therein, and a plasticizer composed of a humic acid derivative.

According to a second aspect of the invention, there is provided a process for producing a coal-water mixture, comprising the steps of grinding-coal into coal powder, mixing the coal powder with acid, and adding water and a plasticizer composed of a humic, acid derivative.

DETAILED DESCRIPTION OF THE INVENTION

A coal-water mixture includes water and coal powder suspended therein. The coal-water mixture of the present; invention is characterized in that a plasticizer, composed of a humic acid derivative, is further contained therein. Furthermore, the process of the invention is characterized in that, after coal is ground into coal powder and mixed with an acid, water and a plasticizer, composed of a humic acid derivative, is added thereto.

The present invention is generally directed to a coal-water mixture having a viscosity of no greater than 1.0 Pa.sec., and a velocity of deformation $\ddot{E}$ of 9 $sec^{-1}$. The coal content of the coal-water mixture of the invention varies depending on the kind of coal to be used and the ash (mineral) content thereof, but is preferably between 60 and 65% by weight. However, the coal content is not limited to this range, and it may vary as long as it is within the range of 55 to 70% by weight. With respect to the kind of the coal,enriched coal with an ash or mineral content of no greater than 2.5% by weight and of low stages of metamorphism are preferably used. More specifically, cannel coal or jet coal and fiery coal or gas coal or light coal are the most preferable. Coals of higher stages of metamorphism have higher calorie contents, but are more expensive, and are more difficult to maintain in suspension because of lower oxygen content. Therefore, coals of low stages of metamorphism are preferable.

Figure 1:
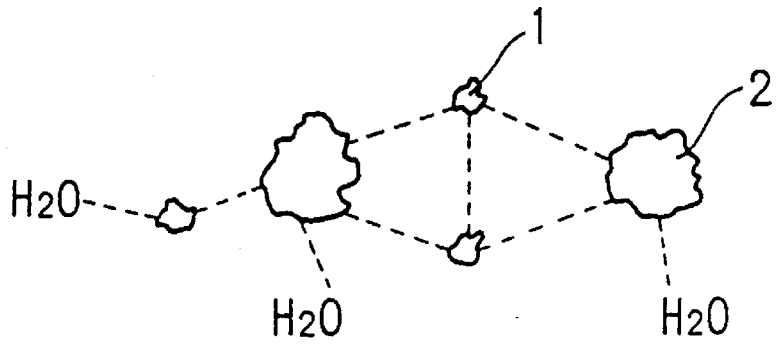
FIG. 1 is a schematic view showing the interrelationship between fine coal particles and coarse coal particles in a coal-water mixture in accordance with the present invention.

Coal powder is obtained by grinding at least one of the aforesaid coals. In the grinding, the coal may be ground into fine coal particles of a small size in order to improve suspension. However, if all the coal particles are made so as to be of a small size, they tend to interact with each other, and the resulting solution becomes more viscous. Therefore, it is preferable that coarse coal particles of a larger size be mixed with fine coal particles. In such a mixture, as schematically depicted in FIG. 1, the fine particles 1 interact with the coarse particles 2, thereby facilitating maintaining the suspension without increasing viscosity. In the foregoing, it is preferable that the coarse particles have a particle size of 0.1 to 0.2 mm, while the fine particles have a particle size of no greater than 0.05 mm. In addition, it is preferable that 40 to 60 weight % of the coarse particles be mixed with 60 to 40 weight % of the fine particles, and it is more preferable to mix equal amounts of fine and coarse particles.

The humic acid derivative used as the plasticizer may, for example, be a salt of humic acid containing sulfite ions. Such a salt of humic acid can be produced from brown coal by grinding it into coal powder, adding caustic soda (NaOH) powder and sodium sulfite ($Na_2SO_3$) powder, and mixing them together. Natural humic acids are weak acids which show anion active, surface active properties. It is possible to increase the strength of the humic acids by adding sulfo groups.

The following are the detailed procedures for the preparation of the aforesaid salt of humic acid. 1) Brown coal is first ground into a fine powder. The smaller particle size gives a better reaction. 2) Brown coal powder thus prepared is mixed with NaOH powder and Na2SO3 powder in the following ratios:

| | |
|---|---|
| Brown coal powder: | 68 weight % |
| NaOH powder: | 12 weight % |
| $Na_2SO_3$ powder: | 20 weight % |

The three powders are placed together in a high-energy, vibrational blender. The blender then grinds and compresses the material, yielding a fine powder. Naturally, speed and reaction time vary depending on the type of blender used. With the above mixing, the following mechanical-chemical reaction (1) occurs, and the molecular mass is reduced. In addition, a salt of humic acid containing sulfite ion is obtained according to the following chemical reaction (2).

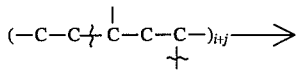

(1)

-continued

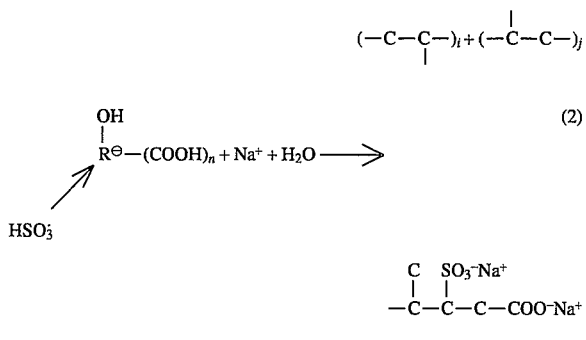

(2)

In the foregoing, it may be possible to increase the sulfo group quantity (and therefore increase the active area) of the humic acid macromolecule structure using a vibrational blender of greater power on the initial mixture.

In order to extract the aforesaid sulphated sodium humate, distilled water is added, and the resulting mixture is heated while mixing. As a result, the humic acid dissolves in the water. Hence, a centrifugal operation is carried out to remove the unnecessary sediment. In this operation, the higher the centrifugal speed, the clearer the resulting solution.

Figure 2:
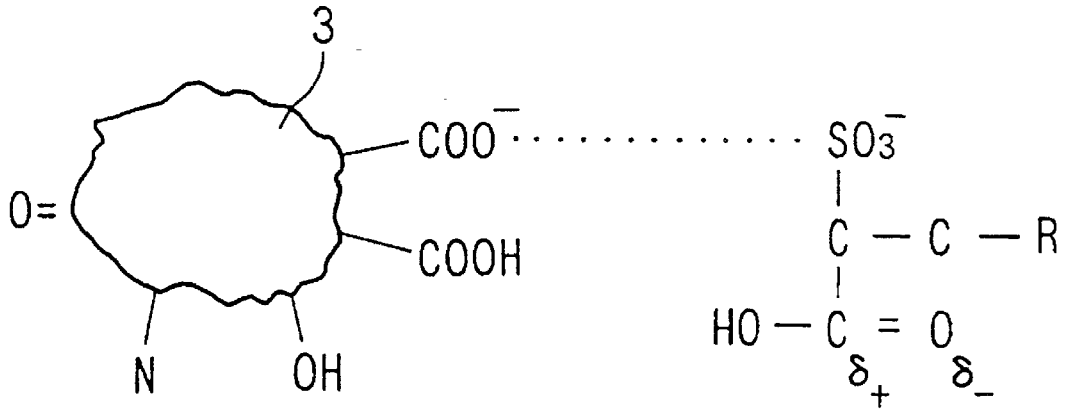
FIG. 2 is a schematic view showing the manner in which a plasticizer interacts with a coal particle.

With the addition of the plasticizer as described above, as schematically depicted in FIG. 2, the plasticizer interacts with the coal particles 3 to interpose between the coal particles 3 to thereby maintain the coal particles in a suspended state, so that the viscosity of the coal-water mixture can be sufficiently reduced.

However, the above plasticizer is not inherently stable, and hence a stabilizer is required to be added. It is preferable that ferrum organic complexes extracted from the jet coal or gas coal be used as a stabilizer of this kind since it is not necessary to add any additives independently. More specifically, a mineral acid (HCl, $H_2SO_4$, $HNO_3$) is added to the ground jet coal or gas coal. Best results are obtained with 0.034 to 0.037 mass % of $HNO_3$ (0.1N). As a result of the treatment with the acid, organic-mineral combinations (ferrum complexes $Fe^{3+}$and $Fe^{3+}$) move from the coal structure into the liquid. $Fe^{3+}$influences the structure formation of the coal-water suspension. This influence causes a decrease of the negative charge on the coal structure, and the decreasing charge leads to the decreasing of the dis-attractive forces between the coal particles and to the formation of a coagulation structure.

Thus, a coal-water suspension having an effective viscosity of 400 to 1000 mPa.sec (velocity of deformation Ë=9sec-$^{1}$) and having a coal content of 60 to 65 % by weight is obtained.

As described above, in the coal-water mixture of the invention and the process for producing the same, the coal suspension is maintained by the plasticizer which is composed of humic acid derivative, and therefore no synthetic additives are required. In particular, inasmuch as the humic acid derivative is a natural plasticizer obtainable from coal itself, the previous problem of high manufacturing cost can be obviated.

Furthermore, although it is necessary to add a stabilizer in order to use such humic acid derivative, the ferrum complexes, which can be extracted by adding acid such as mineral acid to the material coal, can be used as such a stabilizer. Therefore, by the addition of the acid, the autostabilization of the plasticizer can be attained, and separate addition of stabilizer can be avoided.

Moreover, by mixing coarse particles and fine particles to produce the coal powder, the fine particles interact with the coarse particles to maintain the coarse particles in the liquid, thereby obtaining good suspension.

The present invention will now be described in more detail by way of the following examples.

EXAMPLE b 1

Jet coal and gas coal obtained from the Kusnetsk basin were used as starting coal material. The coals had the following composition (all represented by weight %).

| | |
|---|---|
| Moisture: | 4.0 |
| Ash: | 2.4 to 5.8 |
| Sulphur: | 0.55 ($S+^{a}$), 0.56 ($S+^{d}$) |
| Volatile matter: | 34.3 ($V^{a}$), 40.2 ($V^{d}$) |
| Carbon: | 66.4 ($C^{a}$) |
| Hydrogen: | 4.6 ($H^{a}$) |

The above coals were first ground into two sizes, i.e., coarse coal particles having a greater particle size of 0.1 to 0.2 mm and fine particles having a smaller particle size of no greater than 0.05. mm and having a mean particle size of 0.01 min. Then, equal mounts of these particles were blended together to obtain coal powder.

In addition, a plasticizer was produced from brown coal from the Ukraine. More specifically, the brown coal was ground into a fine powder, and the resulting powder was mixed with NaOH powder and $Na_2SO_3$ powder at the following ratios:

| | |
|---|---|
| Brown coal powder: | 68 weight % |
| NaOH powder : | 12 weight % |
| $Na_2SO_3$ powder: | 20 weight % |

Then, the three powders were placed together in a high energy, vibrational blender (type 75 DpM; w≧1900; 5 minutes duration) to grind and compress the material, leaving a powder of particle size of less than 0.05 mm. Subsequently, distilled water was added, and heated to 25° C. and mixed to dissolve the humic acid in the water. Then, a centrifuge was used at a rotational speed of 12,000 to 15,000 rpm to remove unnecessary sediment and to obtain a clear solution of humic acid. The humic acid thus obtained was a concentration 6 to 10%, and had 4.0 to 4.2 weight % of sulfo group, 1.0 to 1.2 weight % of carboxyl group and 3.8 to 4.0 weight % of hydroxyl group.

Subsequently, 7 ml of stabilizer composed of $HNO_3$ (0.1 N) was added to 26 g of the above coal powder, and mixed for 3 to 5 minutes either manually or in a centrifuge at low rotational speed. Furthermore, 2.5 ml of salt of humic acid (pH>7) and 4.5 ml of distilled water were added, and mixed for 30 minutes at 1,500rpm. As a result, a coal-water mixture having the following composition (% denotes % by weight) was obtained.

| | |
|---|---|
| Coal: | 65% |
| Plasticizer: | 0.76% |
| Stabilizer: | 0.065% |
| Water: | remainder |

After further analysis, it was found that the resulting coal-water mixture had a viscosity V of 0.46 Pa.sec, a deformation velocity $\ddot{E}$ of 9 $sec^{-1}$, and a dynamical limit of fluidity $R_0$ of 1.5 Pa. Furthermore, during a 15-day period, the change of the viscosity and dynamical limit of fluidity were not more than 4%.

EXAMPLE 2

As was the case with Example 1, 7 ml of $HNO_3$ (stabilizer) was added to 21 g of coal powder, and mixed for 3 to 5 minutes. Subsequently, 1.7 ml of humic acid salt (plasticizer) and 5.3 ml of water were added, and mixed for 30 minutes at 1,500 rpm. In this procedure, it should be noted that it is not possible to add the plasticizer and the stabilizer simultaneously because they neutralize each other.

Thus, a coal water suspension having a coal content of 60% was obtained. This suspension also exhibited excellent viscosity;

Finally, the present application claims the priority of Japanese Patent Application No. 6-75182 filed Apr. 13, 1994, which is herein incorporated by reference.

What is claimed is:

1. A process for producing a coal-water mixture, which comprises the steps of:

i) grinding coal of low stages of metamorphism to produce a coal powder;

ii) extracting a stabilizer from said coal powder, iii) producing a plasticizer composed of a humic acid derivative from brown coal; and iv) mixing water and said plasticizer with said coal powder and said stabilizer to produce a coal-water suspension, wherein said plasticizer is produced by means of a mechanical-chemical reaction.

2. A process for producing a coal-water mixture, which comprises the steps of:

i) grinding coal of low stages of metamorphism to produce a coal powder;

ii) extracting a stabilizer from said coal powder by the steps consisting essentially of adding a mineral acid having an acid concentration of from 0.034% to 0.037% corresponding to a coal content in the range of 60% to 65% to said coal powder resulting in the extraction from said coal of a ferrum organic complex;

iii) producing a plasticizer composed of a humic acid derivative from brown coal; and iv) mixing water and said plasticizer with said coal powder and said stabilizer to produce a coal-water suspension.

3. The process according to claim 2, wherein said mineral acid is selected from the group consisting of $HNO_3$, HCl, and $H_2SO_4$.

4. A process for producing a coal-water mixture, which comprises the steps of:

i) grinding coal of low stages of metamorphism to produce a coal powder;

ii) extracting a stabilizer from said coal powder by the steps consisting essentially of adding a mineral acid having an acid concentration of from 0.034% to 0.037% corresponding to a coal content in the range of 60% to 65% to said coal powder resulting in the extraction from said coal of a ferrum organic complex;

iii) producing a plasticizer composed of a humic acid derivative from brown coal; and iv) mixing water and said plasticizer with said coal powder and said stabilizer to produce a coat-water suspension wherein said plasticizer is produced by means of a mechanical-chemical reaction.

* * * * *